US007150262B2

(12) United States Patent
Demura et al.

(10) Patent No.: US 7,150,262 B2
(45) Date of Patent: Dec. 19, 2006

(54) CONTROL APPARATUS OF INTERNAL COMBUSTION ENGINE

(75) Inventors: Takayuki Demura, Mishima (JP); Koji Morita, Mishima (JP); Kenji Harima, Susono (JP); Kei Masuda, Mishima (JP); Tetsuji Nagata, Nagoya (JP)

(73) Assignees: Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 0 days.

(21) Appl. No.: 11/366,744

(22) Filed: Mar. 3, 2006

(65) Prior Publication Data

US 2006/0231066 A1 Oct. 19, 2006

(30) Foreign Application Priority Data

Apr. 13, 2005 (JP) ..... 2005-115852

(51) Int. Cl.
*F02M 7/28* (2006.01)
*F02D 41/30* (2006.01)

(52) U.S. Cl. ..... 123/305; 123/435

(58) Field of Classification Search ..... 123/305, 123/435, 436, 686; 73/118.2; 701/103–105
See application file for complete search history.

(56) References Cited

U.S. PATENT DOCUMENTS 5,542,395 A * 8/1996 Tuckey et al. ..... 123/497
6,145,490 A * 11/2000 Heidenfelder et al. ..... 123/295
6,708,661 B1 3/2004 Aubourg et al.
2006/0054137 A1* 3/2006 Tokuda et al. ..... 123/431

FOREIGN PATENT DOCUMENTS

| | | | |
|---|---|---|---|
| EP | 0828070 | * | 3/1998 |
| JP | A 11-270385 | | 10/1999 |
| JP | A 2003-041981 | | 2/2003 |
| JP | A 2003-514186 | | 4/2003 |

* cited by examiner

*Primary Examiner*—Hai Huynh
(74) *Attorney, Agent, or Firm*—Oliff & Berridge, PLC

(57) ABSTRACT

A control apparatus of an internal combustion engine includes a fuel pressure sensor to detect the pressure of the fuel supplied from a fuel pump to an injector; an in-cylinder pressure sensor, which serves as a combustion chamber temperature detecting unit that detects the temperature in the combustion chamber or the parameter depending on the temperature, to detect in-cylinder pressure (combustion chamber pressure); and an ECU that controls to execute the first fuel injection of each cylinder by the injector when the fuel pressure detected by the fuel pressure sensor is not less than a predetermined threshold fuel pressure and when the in-cylinder pressure detected by the in-cylinder pressure sensor is not less than a threshold in-cylinder pressure.

3 Claims, 4 Drawing Sheets

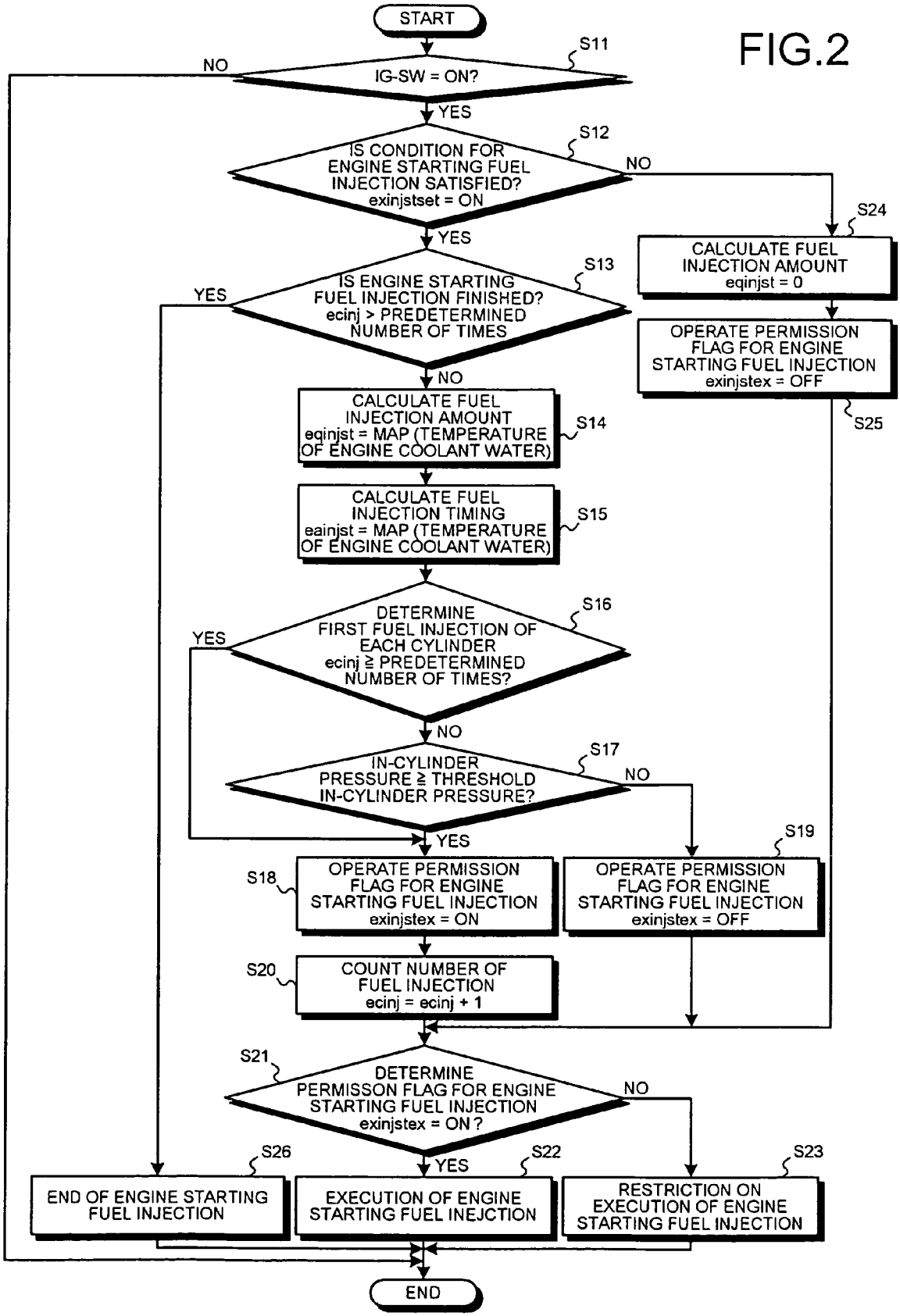
FIG.2
START
S11
IG-SW = ON?
NO
YES
S12
IS CONDITION FOR ENGINE STARTING FUEL INJECTION SATISFIED? exinjstset = ON
NO
YES
S24
CALCULATE FUEL INJECTION AMOUNT eqinjst = 0
S13
IS ENGINE STARTING FUEL INJECTION FINISHED? ecinj > PREDETERMINED NUMBER OF TIMES
YES
NO
OPERATE PERMISSION FLAG FOR ENGINE STARTING FUEL INJECTION exinjstex = OFF
S25
CALCULATE FUEL INJECTION AMOUNT eqinjst = MAP (TEMPERATURE OF ENGINE COOLANT WATER)
S14
CALCULATE FUEL INJECTION TIMING eainjst = MAP (TEMPERATURE OF ENGINE COOLANT WATER)
S15
S16
DETERMINE FIRST FUEL INJECTION OF EACH CYLINDER ecinj ≧ PREDETERMINED NUMBER OF TIMES?
YES
NO
S17
IN-CYLINDER PRESSURE ≧ THRESHOLD IN-CYLINDER PRESSURE?
NO
YES
S19
S18
OPERATE PERMISSION FLAG FOR ENGINE STARTING FUEL INJECTION exinjstex = ON
OPERATE PERMISSION FLAG FOR ENGINE STARTING FUEL INJECTION exinjstex = OFF
S20
COUNT NUMBER OF FUEL INJECTION ecinj = ecinj + 1
S21
DETERMINE PERMISSON FLAG FOR ENGINE STARTING FUEL INJECTION exinjstex = ON ?
NO
YES
S26
S22
S23
END OF ENGINE STARTING FUEL INJECTION
EXECUTION OF ENGINE STARTING FUEL INEJCTION
RESTRICTION ON EXECUTION OF ENGINE STARTING FUEL INJECTION
END

CONTROL APPARATUS OF INTERNAL COMBUSTION ENGINE

BACKGROUND OF THE INVENTION

1. Field of the Invention

The present invention relates to a control apparatus of an internal combustion engine which properly controls the timing of the first fuel injection for engine starting to improve engine startability.

2. Description of the Related Art

Conventionally, an in-cylinder injection type of internal combustion engine has widely been used, in which fuel is injected not to an air-intake port but directly to a combustion chamber. In this in-cylinder injection type of internal combustion engine, air is drawn into the combustion chamber through the air-intake port when an air-intake valve is opened, and the air is compressed as a piston moves up. Then fuel is injected directly to the intake air or the compressed high-pressure air through a fuel injection valve. Consequently, the high-pressure air and the misty fuel are mixed in the combustion chamber. The air-fuel mixture is exploded by spark plug ignition, and the exhaust gas exits through the air-intake port when an exhaust valve is opened.

In this in-cylinder injection type of internal combustion engine, a fuel combustion condition is controlled by changing fuel injection timing depending on an operation status of the internal combustion engine. Specifically, when the internal combustion engine is in low load conditions, fuel is injected into the high-pressure air in the compression stroke to form the air-fuel mixture within a limited area in the combustion chamber. The high-pressured air-fuel mixture is ignited by the spark plug, resulting in stratified combustion. When the internal combustion engine is in middle or high load conditions, fuel is injected into the intake air in the intake stroke to form the air-fuel mixture which disperses in all over the combustion chamber. The air-fuel mixture dispersing in the combustion chamber, which is compressed, is ignited by the spark plug, resulting in homogeneous combustion.

Such an in-cylinder injection type of internal combustion engine requires high-pressure fuel to atomize the injected fuel in addition to the high-pressure air when fuel injection is performed in the compression stroke. This is because the time period from the injection to combustion is short. For this reason, the fuel in a fuel tank is pressured by using a high-pressure pump to feed the high-pressure fuel to an injector. This type of internal combustion engine is disclosed in, for example, Japanese Patent Application Laid-Open (JP-A) No. H11-270385.

In the internal combustion engine described in JP-A No. H11-270385, fuel pumped from a fuel tank by a low-pressure pump is made high-pressure by a high-pressure pump to feed to a fuel injection valve. In-cylinder fuel injection is not allowed until the fuel pressure exceeds a predetermined level at an early stage of engine starting, and in the meanwhile, the fuel pressure is immediately increased, so that engine startability is improved with prompt atomization of the injected fuel from the beginning of the injection.

However, in the in-cylinder injection type of internal combustion engine, even when the fuel pressure injected through the fuel injection valve is high, fluctuations in temperature or pressure inside the combustion chamber combustion would cause fluctuations in atomization of the fuel to be injected from the fuel injection valve, thereby not keeping combustion stable. In this case, internal combustion engines having the same system may have manufacturing or assembling tolerances and assembling variations, which may cause fluctuations in temperature or pressure inside the combustion chamber depending on the individual internal combustion engine. Hence, only controlling the fuel pressure makes it difficult to keep the combustion state stable with uniform atomization of the injected fuel.

SUMMARY OF THE INVENTION

It is an object of the present invention to solve the problems as described above. In particular, an object of the present invention is to provide a control apparatus of an internal combustion engine which uniformly atomizes the injected fuel to keep the combustion stable and therefore to improve engine startability.

A control apparatus of an internal combustion engine according to one aspect of the present invention includes a combustion chamber; an air-intake port and an exhaust port (that communicate with the combustion chamber; an air-intake valve that opens and closes the air-intake port; an exhaust valve that opens and closes the exhaust port; a fuel injection unit that injects fuel into the combustion chamber; a fuel supplying unit that supplies fuel to the fuel injection unit; a fuel pressure detecting unit that detects a pressure of fuel supplied from the fuel supplying unit to the fuel injection unit; a combustion chamber temperature detecting unit that detects a temperature parameter of the combustion chamber; and a fuel injection control unit that causes the fuel injection unit to execute a first fuel injection when the pressure detected by the fuel pressure detecting unit is not less than a predetermined threshold fuel pressure and when the temperature parameter of the combustion chamber detected by the fuel pressure detecting unit is not less than a predetermined threshold temperature.

In the control apparatus, the combustion chamber temperature detecting unit may be a combustion chamber pressure detecting sensor that detects a pressure in the combustion chamber as the temperature parameter.

In the control apparatus, the fuel injection control unit may set the threshold temperature according to a temperature of engine coolant water.

The control apparatus of the internal combustion engine according to the present invention includes the fuel pressure detecting unit that detects a pressure of fuel to be supplied from the fuel supplying unit to the fuel injection unit, and the combustion chamber temperature detecting unit that detects a temperature parameter of the combustion chamber. The fuel injection control unit controls the fuel injection unit to execute the first fuel injection of each cylinder when the fuel pressure is not less than the predetermined threshold fuel pressure and when the temperature parameter is not less than the threshold temperature at the time of engine starting. Hence, high-pressured fuel is injected into the combustion chamber kept at high temperature or high pressure, which enables uniform atomization of fuel to be injected into the combustion chamber, and stable combustion, resulting in improvement in engine startablity.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 2 is a flowchart of an engine start control in the control apparatus of the internal combustion engine according to the embodiment of the present invention;

DETAILED DESCRIPTION OF THE PREFERRED EMBODIMENTS

Exemplary embodiments of a control apparatus of an internal combustion engine according to the present invention will be described in detail below with reference to the accompanying drawings. Note that the present invention is not limited to the particular embodiments.

Figure 1:
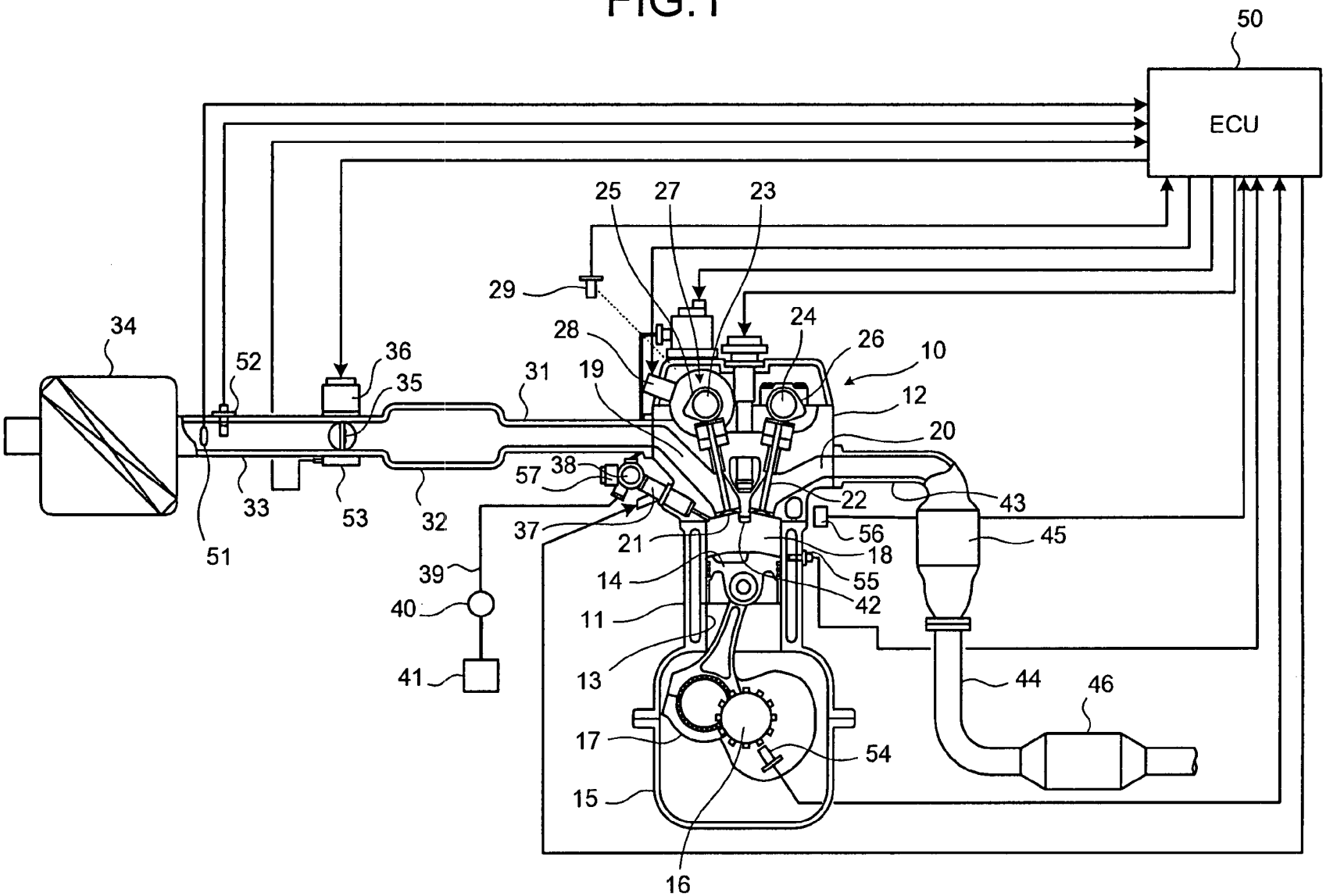
FIG. 1 is a schematic diagram of a control apparatus of an internal combustion engine according to an embodiment of the present invention.
Figure 3:
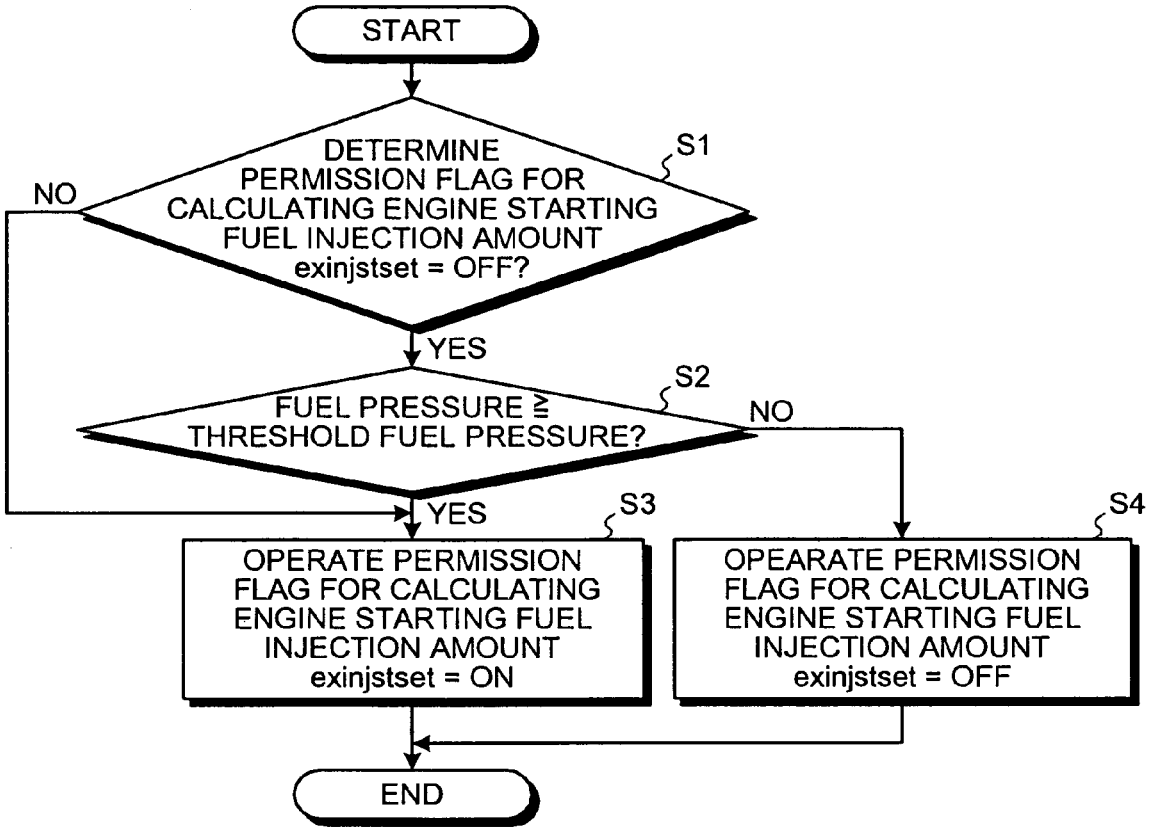
FIG. 3 is a flowchart of a determination control of a condition for engine starting fuel injection in the control apparatus of the internal combustion engine according to the embodiment of the present invention.
Figure 4:
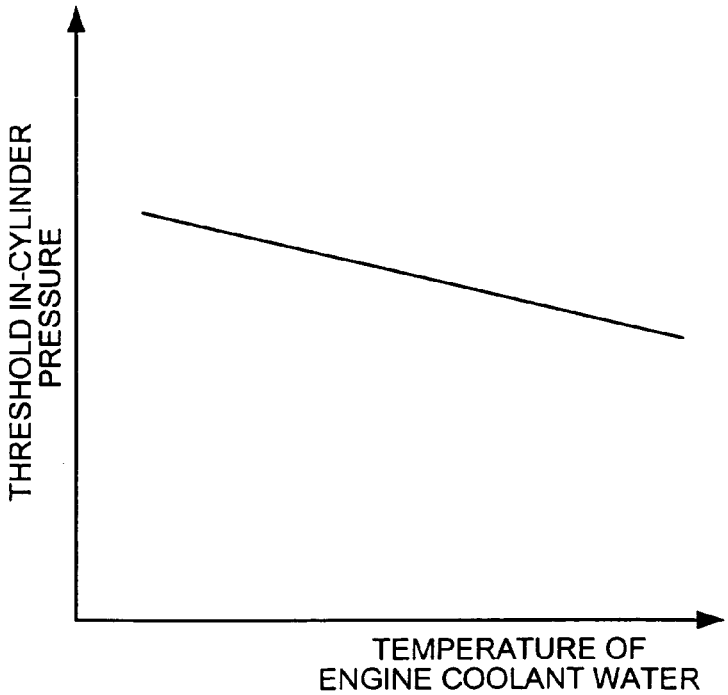
FIG. 4 is a graph showing a relationship of threshold in-cylinder pressure to temperature of engine coolant water.
Figure 5:
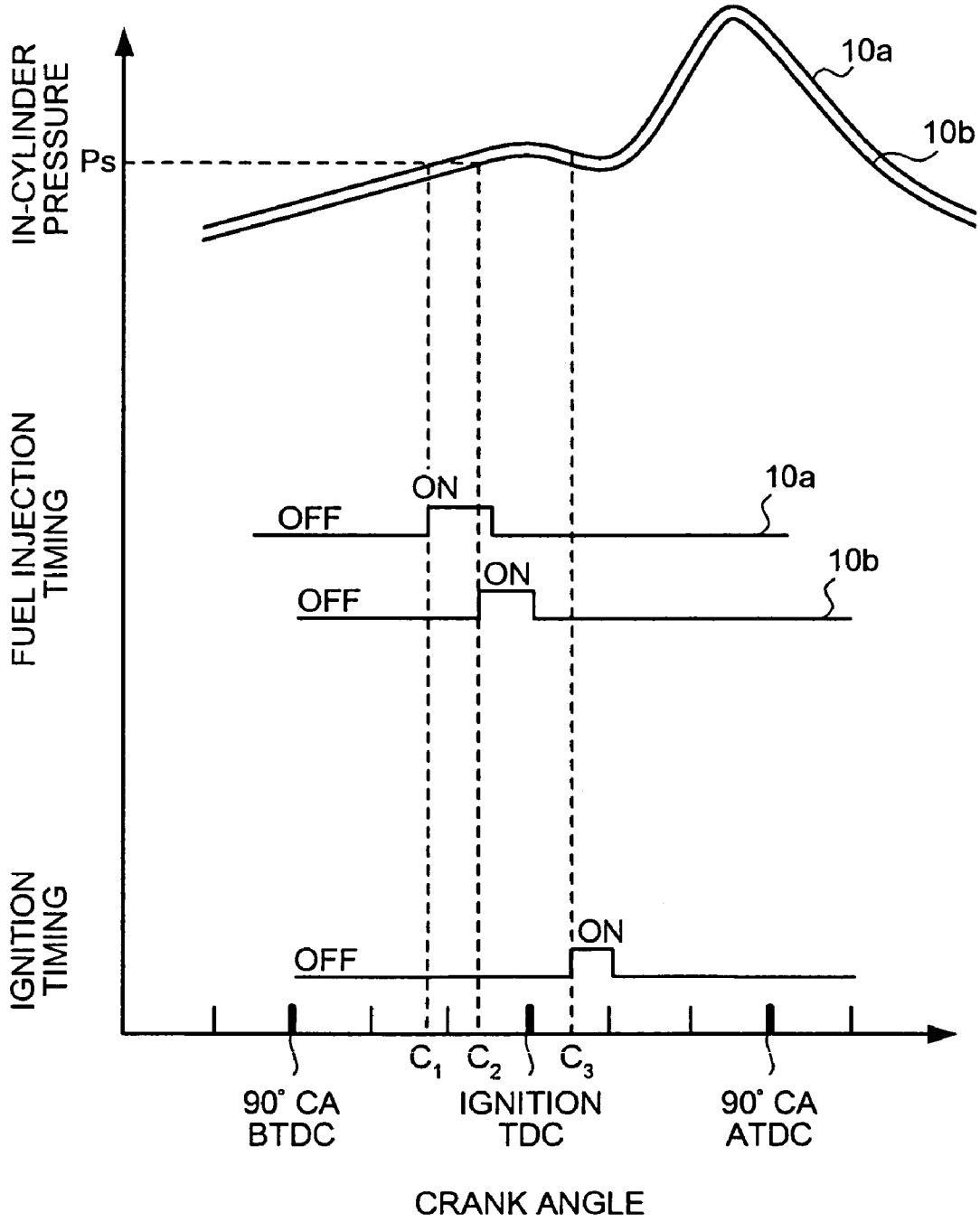
FIG. 5 is a timing chart showing a relationship of in-cylinder pressure, fuel injection timing, and ignition timing to crank angel.

FIG. 1 is a schematic diagram of a control apparatus of an internal combustion engine according to an embodiment of the present invention; FIG. 2 is a flowchart of an engine start control in the control apparatus of the internal combustion engine according to the embodiment of the present invention; FIG. 3 is a flowchart of a determination control of a condition for engine starting fuel injection in the controlling apparatus of the internal combustion engine according to the embodiment of the present invention; FIG. 4 is a graph showing a relationship of threshold in-cylinder pressure to temperature of engine coolant water; and FIG. 5 is a timing chart showing a relationship of in-cylinder pressure, fuel injection timing, and ignition timing to crank angle.

As shown in FIG. 1, the internal combustion engine 10 to be controlled by the internal combustion engine according to the embodiment of the present invention, which is an in-cylinder injection type of four-cylinder engine, includes a cylinder block 11 on which a cylinder head 12 is mounted, and pistons 14 which is mounted to be vertically movable in respective cylinder bores 13 formed in the cylinder block 11. A crankcase 15 is connected to the bottom of the cylinder block 11; a crankshaft 16 is rotatably supported inside the crankcase 15; and each piston 14 is connected to the crankshaft 16 via a connecting rod 17.

A combustion chamber 18 consists of the cylinder block 11, cylinder head 12, and piston 14. The combustion chamber 18 has a pent-roof shape, whose top is the center portion of its upper surface (i.e., the bottom surface of the cylinder head 12) and which has slopes to the top. An air-intake port 19 and an exhaust port 20 are formed on opposite sides of the upper surface of the combustion chamber 18, i.e., the bottom surface of the cylinder head 12. An end portion of an air-intake valve 21 is located in the air-intake port 19 and an end portion of an exhaust valve 22 is located in the exhaust port 20. The air-intake valve 21 and the exhaust valve 22 are supported to be movable in an axial direction toward the cylinder head 12 and to be biased in directions that the air-intake port 19 and the exhaust port 20 are closed, respectively. An air-intake camshaft 23 and an exhaust camshaft 24 are rotatably supported in the cylinder head 12. An air-intake cam 25 and an exhaust cam 26 are in contact with upper sides of the air-intake valve 21 and the exhaust valve 22 via a roller rocker arm (not shown), respectively.

When the air-intake camshaft 23 and the exhaust camshaft 24 rotate in synchronization with the internal combustion engine 10, the air-intake cam 25 and the exhaust cam 26 put the roller rocker arm into operation. Vertical movements of the air-intake valve 21 and the exhaust valve 22 in a predetermined timing allow opening and closing the air-intake port 19 and the exhaust port 20 respectively, which enables communication between the air-intake port 19 and the combustion chamber 18, and between the combustion chamber 18 and the exhaust port 20.

This valve operating mechanism of the internal combustion engine 10 is an electrically-operated Variable Valve Timing-intelligent (VVT) mechanism 27, in which the air-intake valve 21 is controlled to open and close in most suitable timing, depending on the operational status (operation parameters) of the internal combustion engine 10. This VVT mechanism 27 includes a VVT controller (not shown) provided at the end of the air-intake camshaft 23, for example. An electric motor 28 changes a phase of the air-intake camshaft 23 with respect to a cam sprocket wheel, which enables advancing or retarding the timing of opening and closing the air-intake valve 21. In this case, the VVT mechanism 27 advances or retards the timing of opening and closing the air-intake valve 21 in keeping the action angle (period of the air-intake valve 21 being open) constant. The air-intake camshaft 23 is provided with a cam position sensor 29 to detect its rotation phase.

A surge tank 32 is connected to the air-intake port 19 via an intake manifold 31, and is also connected to an air-intake tube 33. An air cleaner 34 is attached to an opening for air intake of the air-intake tube 33. An electronic throttle device 36 having a throttle valve 35 is provided downstream of the air cleaner 34. An injector 37 (fuel injection unit), which injects fuel directly into the combustion chamber 18 is mounted on the cylinder head 12. The injector 37 is located on the side of the air-intake port 19 with a predetermined inclination toward up and down direction. The injector 37 is also connected to each injector 37 of the other cylinders via a delivery pipe 38. The delivery pipe 38 is connected to a fuel pump 40 (fuel supplying unit) and a fuel tank 41 via a fuel supplying tube 39. Further, a spark plug 42 located above the combustion chamber 18 to ignite the air-fuel mixture is attached to the cylinder head 12.

In contrast, an exhaust tube 44 is connected to the exhaust port 20 via an exhaust manifold 43, and catalytic devices 45 and 46 are attached to the exhaust tube 44 to clean hazardous substances such as HC, CO, and NOx contained in exhaust gas.

A vehicle is equipped with an electronic control unit 50 (ECU) which can control the injector 37, the spark plug 43, and the likes. More specifically, an air-flow sensor 51 and an intake air temperature sensor 52 are provided upstream of the air-intake tube 33 to output the measured intake air amount and intake air temperature to the ECU 50. A throttle position sensor 53 is mounted in the electronic throttle device 36 to output the current opening angle of the throttle to the ECU 50. A crank angle sensor 54 detects a crank angle of each cylinder to output to the ECU 50. Then, the ECU 50 discriminates each stroke of air-intake, compression, expansion (explosion), and exhaust in each cylinder based on the detected crank angle, and calculates the number of engine revolution. The cylinder head 12 is provided with a water temperature sensor 55 to detect the temperature of engine coolant water and to output the detection result to the ECU 50. The cylinder head 12 is also provided with an in-cylinder pressure sensor 56 to detect a pressure in the combustion chamber 18, i.e., in-cylinder pressure and to output the detection result to the ECU 50. Further, the delivery pipe 38 is provided with a fuel pressure sensor 57 (fuel pressure detecting unit) to detect a fuel pressure which is made high-pressure by the fuel pump 40 and to output the detection result to the ECU 50.

Accordingly, the ECU 50 determines the fuel injection amount, injection timing, and ignition timing based on the detected operation parameters of the internal combustion engine such as intake air amount, intake air temperature, opening angle of the throttle (or opening angle of an accelerator), the number of engine revolution, temperature of the engine coolant water, in-cylinder pressure, and fuel pressure.

The ECU 50 can control the VVT mechanism 27 based on the operational status (operation parameters) of the internal combustion engine, and performs a feedback control based on the detection result obtained by the cam position sensor 29. More specifically, when the current condition of the internal combustion engine is low temperature, engine starting, idling state, or low load, the period of the exhaust valve 22 being closed and the period of the air-intake valve 21 being open are prevented from overlapping, which enables less amount of backflow of the exhaust gas to the air-intake port 19 or the combustion chamber 18, resulting in improvements in combustion stability and fuel consumption. When the current condition of the internal combustion engine is middle load, the period of the exhaust valve 22 being closed and the period of the air-intake valve 21 being open are controlled to overlap more with each other, which enables a higher rate of exhaust gas recirculation (EGR) inside the combustion chamber and reduction of pumping loss, each resulting in improvements in efficiency in cleaning exhaust gas and fuel consumption. Further, when the current condition of the internal combustion engine is high load with low or middle engine revolution, the timing of closing the air-intake valve 21 is advanced, which enables less amount of backflow of the intake air to the air-intake port 19, resulting in improvement in volumetric efficiency. When the current condition of the internal combustion engine is high load with high engine revolution, the timing of closing the air-intake valve 21 is retarded in accordance with the number of engine revolution, which realizes suitable timing for the inertia force of the intake air, resulting in improvement in volumetric efficiency.

In the embodiment, the in-cylinder pressure sensor 56 (combustion chamber pressure detecting sensor) to detect in-cylinder pressure (combustion chamber pressure), which serves as a combustion chamber temperature detecting unit that detects temperature in the combustion chamber 18 or a parameter depending on the temperature, is provided. The ECU 50 (fuel injection control unit) is configured to execute the first fuel injection of each cylinder by the injector 37 when the fuel pressure detected by the fuel pressure sensor 57 is not less than a predetermined fuel pressure (threshold fuel pressure) and when the in-cylinder pressure detected by the in-cylinder pressure sensor 56 is not less than a predetermined in-cylinder pressure (threshold temperature) at starting of the internal combustion engine 10.

Here, an engine start control of the control apparatus of the internal combustion engine according to the above embodiment of the present invention will be described in detail with reference to the flowcharts in FIGS. 2 and 3.

In the engine start control of the internal combustion engine 10 as shown in FIG. 2, it is determined whether an ignition key switch (IG-SW) is turned ON at step S11. When IG-SW=ON, the process moves to step S12, whereas the process exits this routine when IG-SW=OFF. With IG-SW=ON, it is determined whether the condition for engine starting fuel injection is satisfied at step S12. In other words, it is determined whether a permission flag for calculating engine starting fuel injection amount is ON, i.e., exinjstset=ON.

In a determination control of a condition for engine starting fuel injection, i.e., a switching control of the permission flag for calculating engine starting fuel injection amount "exinjstset" as shown in FIG. 3, a determination of the permission flag for calculating engine starting fuel injection amount is performed at step S1, in which it is determined whether esinjstset=OFF. When exinjstset=OFF at step S1, it is determined whether the fuel pressure detected by the fuel pressure sensor 57 is not less than the threshold fuel pressure at step S2. When the fuel pressure detected by the fuel pressure sensor 57 is not less than the threshold fuel pressure at step S2, the permission flag for calculating engine starting fuel injection amount is set to ON, i.e., exinjstset=ON at step S3. When the fuel pressure detected by the fuel pressure sensor 57 is less than the threshold fuel pressure at step S2, the permission flag for calculating engine starting fuel injection amount is set to OFF, i.e., exinjstset=OFF at step S4. If the permission flag for calculating engine starting fuel injection amount is not OFF, i.e., exinjstset=OFF at step S1, the status of the permission flag for calculating engine starting fuel injection amount is maintained ON, i.e., exinjstset=ON at step S3.

In such a manner, the switching control of the permission flag for calculating engine starting fuel injection amount "exinjstset" allows determination of exinjstset=ON or exinjstset=OFF. Accordingly, based on the determination result of the permission flag for calculating engine starting fuel injection amount, it is determined whether the condition for engine starting fuel injection is satisfied at step S12 as shown in FIG. 2. When the permission flag for calculating engine starting fuel injection amount is ON, i.e., exinjstset=ON at step S12, the process moves to step S13 to determine whether engine starting fuel injection is finished based on the number of fuel injection "ecinj" after engine starting. More specifically, at step S13 it is determined whether the number of fuel injection "ecinj" after engine starting is not more than a predetermined number of times (six times, for example). When the number of fuel injection "ecinj" is not more than the predetermined number of times, it is determined that the engine starting fuel injection is not finished, and the process moves to step S14.

When the permission flag for engine starting fuel injection amount is OFF, i.e., exinjstset=OFF at step S12, the process moves to step S24, setting the engine starting fuel injection amount to 0, i.e., eqinjst=0. Then a permission flag for engine starting fuel injection "exinjstex" is set to OFF at step S25.

At step S14, the amount of engine starting fuel injection is calculated, and timing of fuel injection is calculated at step S15. In this case, the amount of engine starting fuel injection "eqinjst" is calculated based on the temperature of engine coolant water detected by the water temperature sensor 55 by using a map based on a predetermined temperature of engine coolant water. In the same manner, the timing of fuel injection "eainjst" is calculated based on the temperature of engine coolant water detected by the water temperature sensor 55 by using a map based on a predetermined temperature of engine coolant water.

At step S16, it is determined whether the first fuel injection of each cylinder at engine starting is finished, based on the number of fuel injection "ecinj" after engine starting. More specifically, at step S16, it is determined whether the number of fuel injection "ecinj" is less than a predetermined number of times (four times in case of four-cylinder engine). When the number of fuel injection "ecinj" is less than the predetermined number of times, it is determined that the first fuel injection of each cylinder has not been finished, and the process moves to step S17. At step S17, it is determined whether the in-cylinder pressure detected by the in-cylinder pressure sensor 56 is not less than a predetermined threshold in-cylinder pressure. The threshold in-cylinder pressure is set depending on the temperature of engine coolant water. Specifically as shown in FIG. 4, threshold in-cylinder pressure is set based on a map showing threshold in-cylinder pressure dropping in accordance with rising of the temperature of engine coolant water.

When the in-cylinder pressure is not less than the threshold in-cylinder pressure at step S17, the process moves to step S18 to set the permission flag for engine starting fuel injection "exinjstex" to ON. Then at step S20, counting the number of fuel injection is performed, in which the number of fuel injection is incremented by one, i.e., ecinj=ecinj+1. When the in-cylinder pressure is less than the threshold in-cylinder pressure, the process moves to step S19 to set the permission flag for engine starting injection "exinjstex" to OFF. At step S21, a determination of the permission flag for engine starting fuel injection is performed. When the permission flag for engine starting fuel injection is ON, i.e., exinjstex=ON at step S21, an engine starting fuel injection, i.e., the first fuel injection of a cylinder is executed by the injector 37 at step S22. On the other hand, when the permission flag for engine starting fuel injection is OFF, i.e., exinjstex=OFF, the execution of engine starting fuel injection, i.e., the first fuel injection of a cylinder by the injector 37 is restricted at step S23.

When an engine starting fuel injection of each cylinder performed by each injector 37 for the first time (the first fuel injection) is executed, the process starting from step S11 is repeated. When the number of fuel injection "ecinj" becomes four or more, the permission flag for engine starting fuel injection "exinjstex" is set to ON at step S18 without going through the process to determine the in-cylinder pressure at step S17, the processing for counting the number of fuel injection is performed at step S20, and another engine starting fuel injection is executed by the injector 37 at step S22 after the determination of the permission flag for engine starting fuel injection at step S21.

Consequently, when the number of fuel injection "ecinj" exceeds six times, it is determined that the number of fuel injection "ecinj" after engine starting is more than the predetermined number of times at step S13, and then the process moves to step S26 to end the engine starting fuel injection.

Next, an engine starting control in the control apparatus of the internal combustion engine according to the embodiment of the present invention will be explained in detail based on the timing flowchart shown in FIG. 5. Here, an engine starting control for two internal combustion engines 10*a* and 10*b*, each having the same combustion system, will be explained.

As shown in FIG. 5, when the internal combustion engines 10*a* and 10*b* receive a starting command (ignition key switch is turned on), each in-cylinder pressure of the internal combustion engines 10*a* and 10*b* rises in reaction to a cranking start. In the internal combustion engine 10*a*, the in-cylinder pressure reaches the threshold in-cylinder pressure $P_s$ at $C_1$ of crank angle, and at this time, the first fuel injection is executed by the injector 37. On the other hand, in the internal combustion engine 10*b*, the in-cylinder pressure reaches the threshold in-cylinder pressure $P_s$ at $C_2$ of crank angle in a certain period after the first fuel injection of the internal combustion engine 10*a*, and at this time, the first fuel injection is executed by the injector 37. Then, the internal combustion engines 10*a* and 10*b* are each ignited by the spark plug 42 at $C_3$ of crank angle after the ignition timing TDC.

In this way, two internal combustion engines 10*a* and 10*b* each having the same combustion system may have fluctuations in in-cylinder pressure because of manufacturing or assembling tolerances and assembling variations. However, each of the two internal combustion engines 10*a* and 10*b* can execute the first fuel injection in the timing when the in-cylinder pressure reaches the threshold $P_s$, resulting in uniform atomization of the injected fuel and thus stable combustion.

The control apparatus of the internal combustion engine according to the embodiment of the present invention includes the fuel pressure sensor 57 to detect the pressure of the fuel supplied from the fuel pump 40 to the injector 37, and the in-cylinder pressure sensor 56, which serves as a combustion chamber temperature detecting unit that detects the temperature in the combustion chamber 18 or the parameter depending on the temperature, to detect in-cylinder pressure (combustion chamber pressure). The ECU 50 controls to execute the first fuel injection of each cylinder by the injector 37 when the fuel pressure detected by the fuel pressure sensor 57 is not less than the predetermined threshold fuel pressure and when the in-cylinder pressure detected by the in-cylinder pressure sensor 56 is not less than the threshold in-cylinder pressure.

Accordingly, the ECU 50 permits fuel injection only when the fuel pressure is not less than the threshold fuel pressure and when the in-cylinder pressure is not less than the threshold in-cylinder pressure at the starting of the internal combustion engine 10, and thus the injector 37 executes the first fuel injection, in which high-pressured fuel at a predetermined temperature is injected into the combustion chamber 18 which is kept at a predetermined high-pressure. Hence, uniform atomization of fuel injected into each cylinder is provided without fluctuations depending on individual combustion chambers 18, which allows stable combustion and improvement in engine startability.

Further, the in-cylinder pressure sensor 56, which serves as the combustion chamber temperature detecting unit that detects the temperature of the combustion chamber 18 or the parameter referred from this temperature, is employed to detect the in-cylinder pressure (combustion chamber pressure). This means that a simple structure with such an existing sensor allows uniform fuel injection into the combustion chamber 18 and improvement in the fuel atomization without incurring additional cost by implementing a separate sensor.

Furthermore, the threshold in-cylinder pressure for determining the in-cylinder pressure at the time of starting of the internal combustion engine 10 is set in accordance with the temperature of engine coolant water. Accordingly, the threshold in-cylinder pressure is controlled to drop in accordance with a rising of the temperature of engine coolant water, which enables setting of a suitable in-cylinder pressure for fuel injection depending on the operational status of the internal combustion engine 10 and results in securing combustion stability.

In the embodiment of the present invention as described above, the in-cylinder pressure sensor 56 is provided to detect the in-cylinder pressure (combustion chamber pressure) as the combustion chamber temperature detecting unit that detects the temperature in the combustion chamber 18 or the parameter depending on the temperature. However, a temperature sensor which can directly detect the temperature in the combustion chamber 18 may be employed and provided to the combustion chamber 18, alternatively. The temperature or the in-cylinder pressure in the combustion chamber 18 may be predicted without using various sensors.

In view of the foregoing, the control apparatus of the internal combustion engine according to the present invention allows the first fuel injection of each cylinder when the fuel pressure and the temperature of the combustion chamber are each not less than respective threshold values at the time of engine starting. This is advantageous to all types of engines as long as it is in-cylinder injection type of internal combustion engine.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A control apparatus of an internal combustion engine, comprising:

a combustion chamber;

an air-intake port and an exhaust port that communicate with the combustion chamber;

an air-intake valve that opens and closes the air-intake port;

an exhaust valve that opens and closes the exhaust port;

a fuel injection unit that injects fuel into the combustion chamber;

a fuel supplying unit that supplies fuel to the fuel injection unit;

a fuel pressure detecting unit that detects a pressure of fuel supplied from the fuel supplying unit to the fuel injection unit;

a combustion chamber temperature detecting unit that detects a temperature parameter of the combustion chamber; and a fuel injection control unit that causes the fuel injection unit to execute a first fuel injection when the pressure detected by the fuel pressure detecting unit is not less than a predetermined threshold fuel pressure and when the temperature parameter of the combustion chamber detected by the combustion chamber temperature detecting unit is not less than a predetermined threshold temperature.

2. The control apparatus according to claim 1, wherein the combustion chamber temperature detecting unit is a combustion chamber pressure detecting sensor that detects a pressure in the combustion chamber as the temperature parameter.

3. The control apparatus according to claim 1, wherein the fuel injection control unit sets the threshold temperature according to a temperature of engine coolant water.

* * * * *